United States Patent [19]

Bernier

[11] Patent Number: 4,788,530

[45] Date of Patent: Nov. 29, 1988

[54] REMOTE SWITCHING DEVICE FOR SMOKE DETECTOR

[76] Inventor: Maurice Bernier, 11085 Paris, Montréal-Nord, Québec, Canada, H1H 4L2

[21] Appl. No.: 107,094

[22] Filed: Oct. 13, 1987

[51] Int. Cl.[4] ..... G08B 23/00; G08B 17/10

[52] U.S. Cl. ..... 340/527; 340/693; 340/628; 340/309.15

[58] Field of Search ..... 340/527, 531, 532, 533, 340/693, 644, 628–634, 309.15; 200/61.03

[56] References Cited

U.S. PATENT DOCUMENTS

| | | | |
|---|---|---|---|
| 4,313,110 | 1/1982 | Subulak et al. | 340/527 |
| 4,383,251 | 5/1983 | Perelli et al. | 340/527 |
| 4,600,314 | 7/1986 | Theriault | 340/527 |
| 4,679,037 | 7/1987 | Bryah et al. | 340/628 |

FOREIGN PATENT DOCUMENTS 1188773 11/1985 Canada .

*Primary Examiner*—Donnie L. Crosland

[57] ABSTRACT

A switching device is enclosed in a casing fixed to a wall below a ceiling-mounted conventional smoke detector, so as to be accessible. The switching device includes a holding relay, a dry-cell battery and a time-delay circuit. The dry-cell battery replaces a similar battery normally in the smoke detector itself. In normal position, the holding relay connects the battery of the switching device to the circuit of the smoke detector. Whenever the smoke detector sounds a false alarm, a house occupant actuates the holding relay to disconnect the smoke detector circuit and stop the alarm. The battery in the switching device thereafter is connected to the time-delay circuit which returns the holding relay to its normal position after a period of, say, twenty minutes.

7 Claims, 1 Drawing Sheet

REMOTE SWITCHING DEVICE FOR SMOKE DETECTOR

FIELD OF THE INVENTION

The present invention relates to ceiling-mounting smoke detectors and, more specifically, to a remote switching device for such smoke detectors.

BACKGROUND OF THE INVENTION

The majority of households are today fitted with smoke detectors of one type or the other. The most simple smoke detector is a battery-operated unit which is generally mounted on the ceiling in a passage, hallway, staircase or the like, in a location where there is at least a partial air flow, so that if a fire does occur, smoke will be monitored by the smoke detector, and a signal given. Most of these smoke detectors have a horn or a buzzer which sounds when the smoke is detected.

One of the problems encountered with these kinds of smoke detectors is the difficulty in resetting the alarm after it has gone off due to a false signal. This false signal usually occurs when cooking or if a fireplace is lit. Once the alarm on the smoke detector begins, it can continue up to 30 minutes before the mechanism of the detecting device resets itself. Thus, the householder has to put up with this alarm for as long as 30 minutes, which is generally considered intolerable. In most cases, householders disconnect the smoke detector, and this has to be done by climbing up and disconnecting the battery. Once the battery is disconnected, it is usually forgotten and not reconnected; therefore, the smoke detector remains inoperative and stays that way. Thus, the whole purpose of the smoke detector is destroyed.

Canadian Pat. No. 1,188,773 dated June 11, 1985 and entitled: "SMOKE DETECTOR INDICATOR", inventor: Laurent Cormier, describes a ceiling-mounted smoke detector which can be turned off in the event of a false alarm and which gives a visual indication of such turn-off condition. However, in this system, the person wishing to turn off the smoke detector still has to climb up to the detector itself or use of long stick to open the switch.

OBJECTS OF THE INVENTION

The object of this invention is to overcome the abovementioned problem by providing a switching device that allows to instantaneously disconnect the power source of a smoke detector if it has been accidentally triggered and that it has a means to visually remind the householder that the smoke detector is disconnected.

Another object of the invention is to provide a switching device that facilitates the operation of changing the battery of the smoke detector if it is discharged.

A still further object of the invention is the provision of a switching device that eliminates the necessity of climbing up to the ceiling to access the battery of the smoke detector.

A still further object of the invention is to provide a switching device extremely easy and inexpensive to manufacture.

SUMMARY OF THE INVENTION

Accordingly, there is disclosed a switching device for a smoke detector of the dry-cell operated type, including a casing adapted to be secured to a ceiling or similar out-of-reach elevated location, a smoke-detecting alarm circuit with positive and negative connectors and adapted to be connected to a dry-cell battery in said casing, said device comprising a housing adapted to be secured in an accessible location below the smoke detector, a holding relay having a winding and armature, a dry-cell battery, a pair of terminals and a time-delay circuit located in said housing, said battery connected to said armature and to one of said terminals, said terminals adapted to be connected by wires to the connectors in said smoke detector casing in lieu of said battery, said armature having a first normal position in which it connects said battery across said terminals, and a second position held by said winding in which it disconnects said battery from the other of said terminals and connects said battery, said winding and time-delay circuit; and further including spring means to return the armature to said first position upon opening of said time-delay circuit. The switching device preferably includes a warning light indicating that the smoke detector is in non-operative mode, said light being mounted in the housing of said switching device.

Preferably, said light source is a light-emitting diode and the time delay circuit includes an integrated circuit serving as switching means and coupled to an R.C. circuit.

The above will better be understood in reference to the following description and drawings of the switching device of the invention.

DETAILED DESCRIPTION OF THE PREFERRED EMBODIMENT

Figure 1:
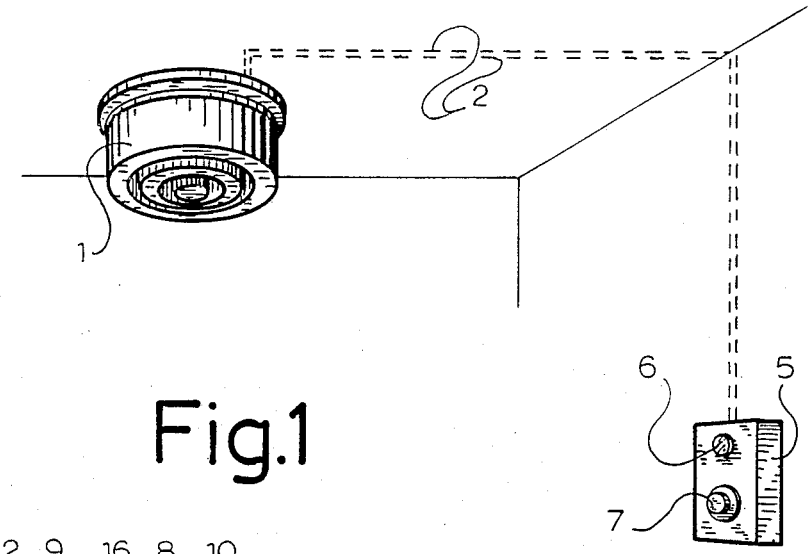
FIG. 1 is a perspective view of a smoke detector and of the switching device of the invention connected thereto.

FIG. 1 shows a conventional ceiling-mounted smoke detector of the type including a smoke-detecting and alarm circuit provided with a connector element having female and male snap-on connectors to be connected to a conventional dry-cell 9-volt battery, which is normally located in the casing 1 of the smoke detector.

In accordance with the invention, the battery in the casing 1 is removed and a pair of wires 2 are connected to the snap-on connectors of the smoke detector at one end, and connected at their other ends to terminals 3 and 4 (see FIG. 2) located in a housing 5 of the switching device in accordance with the invention. Said housing 5 is normally secured to a wall adjacent the smoke detector 1 and below the same, so as to be conveniently accessible to a person standing on the floor of the room where the smoke detector is located.

Figure 2:
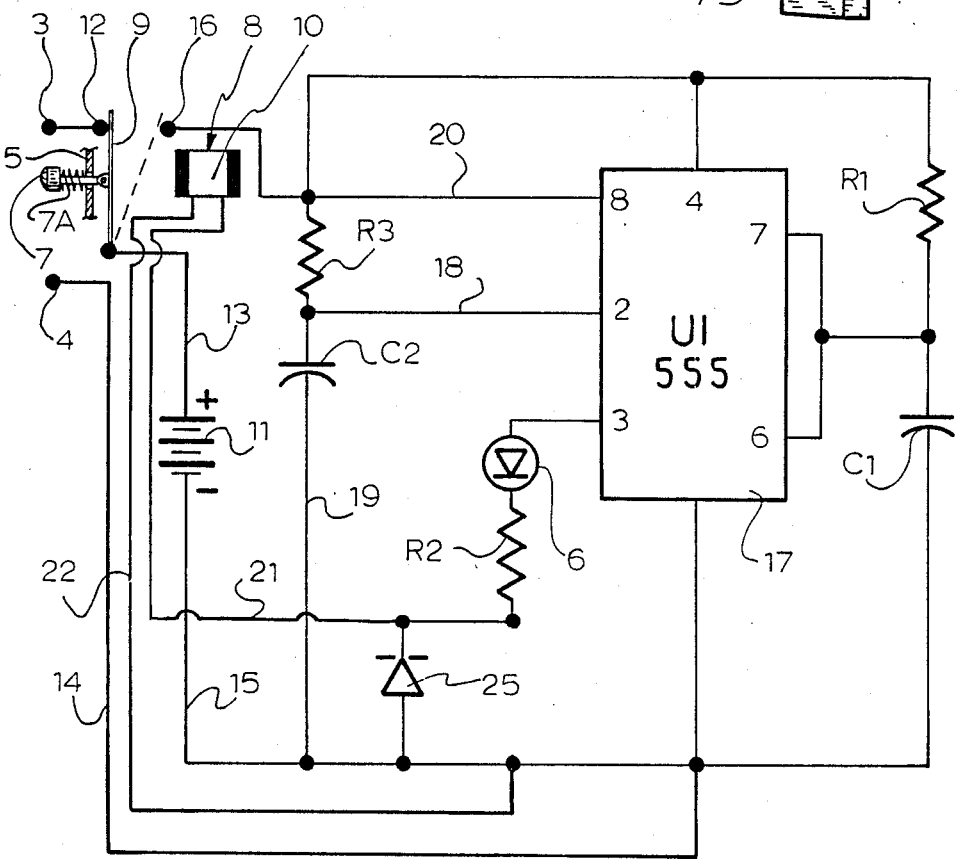
FIG. 2 is a schematic electric circuit of the components located within the housing of the switching device.

Referring to FIG. 1, it is noted that housing 5 carries at its top front face an indicator light source 6 and a push-button 7, both schematically represented in FIG. 2, the light source 6 being in the form of a light-emitting diode.

The switching circuit of the invention, shown in FIG. 2, includes a holding relay, generally indicated at 8, and including a movable armature 9 and a relay winding 10. The positive pole of a dry-cell battery 11 is connected to the armature 9. Armature 9 is normally biased by the coil spring 7*a* of the push-button 7 to a normal position in which is abuts contact 12 of the relay 8, so as to complete the circuit from battery 1*a* to the smoke detector circuit through the following wires: from the positive pole of battery 11, wire 13, armature 9, contact 12, terminal 3, return terminal 4 through the wires 2, wires 14 and 15 to the negative pole of the battery. Thus, the circuit of the smoke detector is constantly fed by battery 11 in the switching device housing 5. Should such battery need replacement, it is conveniently accessible.

When smoke detector 1 emits a false alarm, a person simply pushes on push-button 7 to move the armature 9 to a second position in which it abuts contact 16 of the holding relay 8. The armature 9 is held in this second position by the winding 10 in the following manner: an integrated electronic circuit 17 is provided. This chip has code name U1555. Its terminal 2 is connected by wires 18 and 19 and 15 to the negative pole of battery 11. Its terminal 8 is connected by wire 20 to the contact 16 of the holding relay 8. Its terminal 3 is connected through light-emitting diode 6, resistance R2 and wire 21 to one side of relay winding 10, while the other side of the relay winding is connected by wire 22 and wire 15 to the negative side of battery 11. Terminal 2 of chip 17 is the trigger terminal of a transistor switch in the chip 17, whereby, upon armature 19 abutting contact 16, a negative pulse is imparted at terminal 2, closing the relay winding circuit through battery 11, wire 13, armature 9, contact 16, wire 20, terminals 8, 3, light-emitting diode 6, resistance R2, wire 21, winding 10, wire 22, wire 15 to the negative side of battery 11.

A resistance R1 is connected to terminals 4 and 7 of chip 17, while a capacitor C1 is connected between terminals 6 and 7 of chip 17 on the one hand, and to terminal 1 of chip 17 on the other hand. This provides a time-delay circuit, the duration of which is determined by the respective values of R1 and C1, whereby the connection between terminals 3 and 8 opens after a certain time delay, namely: about twenty minutes. Upon opening of the circuit between terminals 3 and 8 of chip 17, relay winding 10 is de-energized and the armature 9 of the relay returns to its original position, shown in full line in FIG. 2, under the action of the compression coil spring 7A of the push-button 7. Therefore, after about twenty minutes, the smoke detector is returned to operative position; then the warning light 6 comes off.

A diode 25 is connected across wires 15 and 21 and serves to reduce the voltage surge produced by the relay winding 10 upon de-energization of the latter. A resistance R3 is connected across wires 20 and 18 and a capacitor C2 is series connected in wire 19. Resistance R3 and capacitor C2 serve to generate the pulse necessary to trigger the time-delay circuit upon armature 9 abutting contact 16 of the holding relay 8.

Preferably, the various components have the following values: R1 = 10 M ohms one-quarter watt resistance; R2 is a 100 ohm one-quarter watt resistance; R3 is a 1.2K ohms one-quarter watt resistance; diode 6 is a light-emitting red diode; diode 25 bears code number 1N 414B; capacitor C1 is an electrolytic capacitor of 100 micro-farads uf and 16 volts; capacitor C2 is a ceramic capacitor of 0.01 micro-farads uf.

Wires 13 and 15 are preferably connected to the battery 11 by a snap-on female and male connector. Battery 11 is a 9-volt dry-cell battery.

I claim:

1. A switching device for a smoke detector of the dry-cell operated type, including a casing adapted to be secured to a ceiling, or similar out-of-reach elevated location, a smoke-detecting and alarm circuit with positive and negative connectors adapted to be connected to a dry-cell battery in said casing, said device comprising a housing adapted to be secured to an accessible location below said smoke detector, a holding relay having a winding and an armature, a dry-cell battery, a pair of terminals and a time-delay circuit located in said housing, said terminals adapted to be connected by wires to said connectors in said casing; said battery in said housing connected to said armature and parallel-connected to one of said terminals and to said winding; the latter in turn connected to said time delay circuit, said armature having a first normal position in which it connects said battery across said terminals, and a second position held by said winding in which it disconnects said battery from the other of said terminals and connects said battery to said time-delay circuit, and spring means to return said armature to said first position upon opening of said time-delay circuit.

2. A switching device as defined in claim 1, further including a light source connected to said winding to be energized when said winding is energized.

3. A switching device as defined in claim 2, wherein said time-delay circuit comprises a switching means held closed by an R.C. circuit.

4. A switching device as defined in claim 3, wherein said light source is series connected with said winding.

5. A switching device as defined in claim 4, wherein said light source is a light-emitting diode.

6. A switching device as defined in claim 4, further including a rectifier diode connected across said winding to prevent voltage surge upon de-energization of the latter.

7. A switching device as defined in claim 5, wherein said relay has a first and a second contact engaged by said armature in the first and second positions of said armature, respectively, wherein said time-delay circuit includes an integrated circuit defined by code name U1-555 having terminals numbered 1, 2, 3, 4, 6, 7, and 8, terminals 1, 4, 6, and 7 being connected to the R.C. circuit; terminals 1, 2, 4, and 8 interconnected and connected to one end of said winding, to the negative pole of said battery, and to the second contact of said relay, and terminal 3 connected to the other side of said winding.

* * * * *